US007854111B2

(12) United States Patent
Murrow et al.

(10) Patent No.: US 7,854,111 B2
(45) Date of Patent: Dec. 21, 2010

(54) AXIAL FLOW POSITIVE DISPLACEMENT TURBINE

(75) Inventors: Kurt David Murrow, Indian Springs, OH (US); Rollin George Giffin, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 538 days.

(21) Appl. No.: 12/044,043

(22) Filed: Mar. 7, 2008

(65) Prior Publication Data

US 2009/0226336 A1 Sep. 10, 2009

(51) Int. Cl.
*F02C 3/02* (2006.01)

(52) U.S. Cl. ..... 60/39.45; 60/726

(58) Field of Classification Search ..... 60/39.45, 60/726; 418/9, 201.1, 202, 48; 123/241, 123/249

See application file for complete search history.

(56) References Cited

U.S. PATENT DOCUMENTS 1,892,217 A * 12/1932 Moineau ..... 74/458
2,553,548 A * 5/1951 Pawl et al. ..... 123/241
3,938,915 A 2/1976 Olofsson
3,947,163 A 3/1976 Olofsson
4,144,001 A * 3/1979 Streicher ..... 418/48
4,317,330 A 3/1982 Brankovics
4,482,305 A 11/1984 Natkai et al.
4,802,827 A 2/1989 Fujiwara et al.
4,818,197 A 4/1989 Mueller
4,863,357 A 9/1989 Olofsson
5,017,087 A 5/1991 Sneddon
5,195,882 A 3/1993 Freeman
6,155,807 A 12/2000 Fenton
6,626,638 B2 9/2003 Rosefsky (Continued)

FOREIGN PATENT DOCUMENTS

EP 302877 B1 12/1991

(Continued)

OTHER PUBLICATIONS

EPO6255326, European Search Report, European Patent Office, Mar. 26, 2007.

(Continued)

*Primary Examiner*—Michael Cuff
*Assistant Examiner*—Vikansha S Dwivedi
(74) *Attorney, Agent, or Firm*—William Scott Andes; Steven J. Rosen

(57) ABSTRACT

An axial flow positive displacement turbine includes inner and outer bodies having offset inner and outer axes respectively extending between a relatively high pressure inlet and a relatively low pressure outlet. At least one of the bodies is rotatable about its axis. The inner and outer bodies have intermeshed inner and outer helical blades wound about the inner and outer axes respectively. The inner and outer helical blades extend radially outwardly and inwardly respectively. Each of the bodies has at least two blades. There is one more or one less outer helical blades than inner helical blades. The inner and outer bodies may both be rotatable about inner and outer axes and geared together in a fixed gear ratio. The turbine may have first and second sections with a first twist slope greater than a second twist slope respectively of the inner and outer helical blades.

46 Claims, 12 Drawing Sheets

U.S. PATENT DOCUMENTS

| | | | | |
|---|---|---|---|---|
| 6,705,849 | B2 | 3/2004 | Zhong et al. | |
| 6,905,319 | B2 | 6/2005 | Guo | |
| 7,624,565 | B2 * | 12/2009 | Murrow et al. | 60/39.45 |
| 7,726,115 | B2 * | 6/2010 | Murrow et al. | 60/39.45 |
| 2004/0005235 | A1 | 1/2004 | Didin | |
| 2005/0089414 | A1 | 4/2005 | Ohman | |
| 2005/0226758 | A1 | 10/2005 | Hossner | |
| 2007/0137173 | A1 | 6/2007 | Murrow et al. | |
| 2007/0137174 | A1 | 6/2007 | Murrow et al. | |
| 2007/0175202 | A1 | 8/2007 | Murrow et al. | |
| 2007/0237642 | A1 | 10/2007 | Murrow et al. | |

FOREIGN PATENT DOCUMENTS

| | | | |
|---|---|---|---|
| EP | 627041 | B1 | 9/1999 |
| EP | 805743 | B1 | 4/2000 |
| EP | 1132618 | A2 | 9/2001 |
| EP | 1500819 | A2 | 1/2005 |
| FR | 787711 | | 9/1935 |
| GB | 427475 | | 4/1935 |
| SE | 89284 | | 5/1937 |
| SU | 1567804 | | 5/1990 |
| WO | WO9747886 | | 12/1997 |

OTHER PUBLICATIONS

QUINDOS, Screw Compressor, M41-155-QNT-001, Measurement of Screw Rotors on Leitz Coordinate Measuring Machines, www.leitz-metrology.com.

Quindos 7, www.quindos.com—home of power analysing tools, Measurement of Screw Compressors.

Power Recovery From Low Cost Two-Phase Expanders, Ian K. Smith, Nikola Stostic and Ahmed Kovacevic, Centre for Positive Displacement Compressor Technology, City University, Northampton Square, London EC1V 0HB, England.

* cited by examiner

AXIAL FLOW POSITIVE DISPLACEMENT TURBINE

BACKGROUND OF THE INVENTION

1. Field of the Invention

The present invention relates generally to positive displacement rotary machines and engines and, more particularly, to turbines.

Positive displacement rotary machines have been used for pumps and engines. Pumps have been implemented in a variety of forms, from linear reciprocating pumps, such as are found in household tire pumps and in most automobile engines, to axial flow and centrifugal pumps such as exist in modern day turbomachinery, and screw and worm pumps. Rotary Wankel engines are one example of positive displacement engines. Axial flow turbines have a wide range of applications for extracting energy from a fluid because of the ability to provide continuous near steady fluid flow. It is a goal of turbine designers to provide light-weight and compact devices. It is another goal to have as few parts as possible in the turbine to reduce the costs of manufacturing, installing, refurbishing, overhauling, and replacing the device.

2. Brief Description of the Invention

A continuous axial flow positive displacement worm turbine includes a relatively high pressure inlet axially spaced apart and upstream from a relatively low pressure outlet. A rotary assembly includes an inner body disposed within an outer body and extending from the inlet to the outlet. The inner and outer bodies have offset linear inner and outer axes about which they rotate or spin, and intermeshed inner and outer helical blades wound about the inner and outer axes respectively. At least one of the inner and outer bodies are rotatable about a respective one of the inner and outer axes. In a preferred embodiment of the worm turbine, the inner and outer bodies are both rotatable about the inner and outer axes respectively.

The inner helical blades extend radially outwardly from an annular inner hub of the inner body and the outer helical blades extend radially inwardly from an annular outer shell of the outer body. The inner hub and the outer shell are circumscribed about the inner and outer axes respectively. The number of the inner helical blades and the number of outer helical blades is each two or more and the number of outer helical blades is one more or one less than the number of inner helical blades. The inner helical blades extend radially outwardly from an inner hub of the inner body and the outer helical blades extend radially inwardly from an outer shell of the outer body. Both bodies are rotatable about their respective axes and rotate in the same direction.

The inner and outer bodies are rotatable about the inner and outer axes respectively in the same inner and outer rotational directions respectively and the inner and outer bodies are geared together in a fixed gear ratio. In one particular embodiment of the turbine, the helical blades have sufficient number of turns to trap fluid charges in the rotary assembly during the turbine's operation. In one particular embodiment of the turbine, the number of outer helical blades is one less than the number of the inner helical blades and the inner body is operable to orbit about the outer axis in an orbital direction and the orbital direction is same as the inner rotational direction.

In another particular embodiment of the turbine, the number of outer helical blades is one more than the number of the inner helical blades and the inner body is operable to orbit about the outer axis in an orbital direction opposite the inner rotational direction.

One embodiment of the turbine includes the outer body being orbitably fixed about the inner axis and the inner body being operable to orbit about the outer axis. Another embodiment of the turbine includes the inner and outer bodies being rotatable about the inner and outer axes respectively in same inner and outer rotational directions respectively and the inner and outer axes are fixed in space and thus neither body orbits the other.

In one embodiment of the turbine, a first ratio of the outer body twist slope of the outer helical blades to an inner body twist slope of the inner helical blades equals a second ratio of the inner number of the inner helical blades on the inner body to the outer number of the outer helical blades on the outer body.

The turbine may have first and second sections with first and second twist slopes of the inner and outer helical blades respectively with first twist slope being greater than the second twist slope.

DETAILED DESCRIPTION OF THE INVENTION

Figure 1:
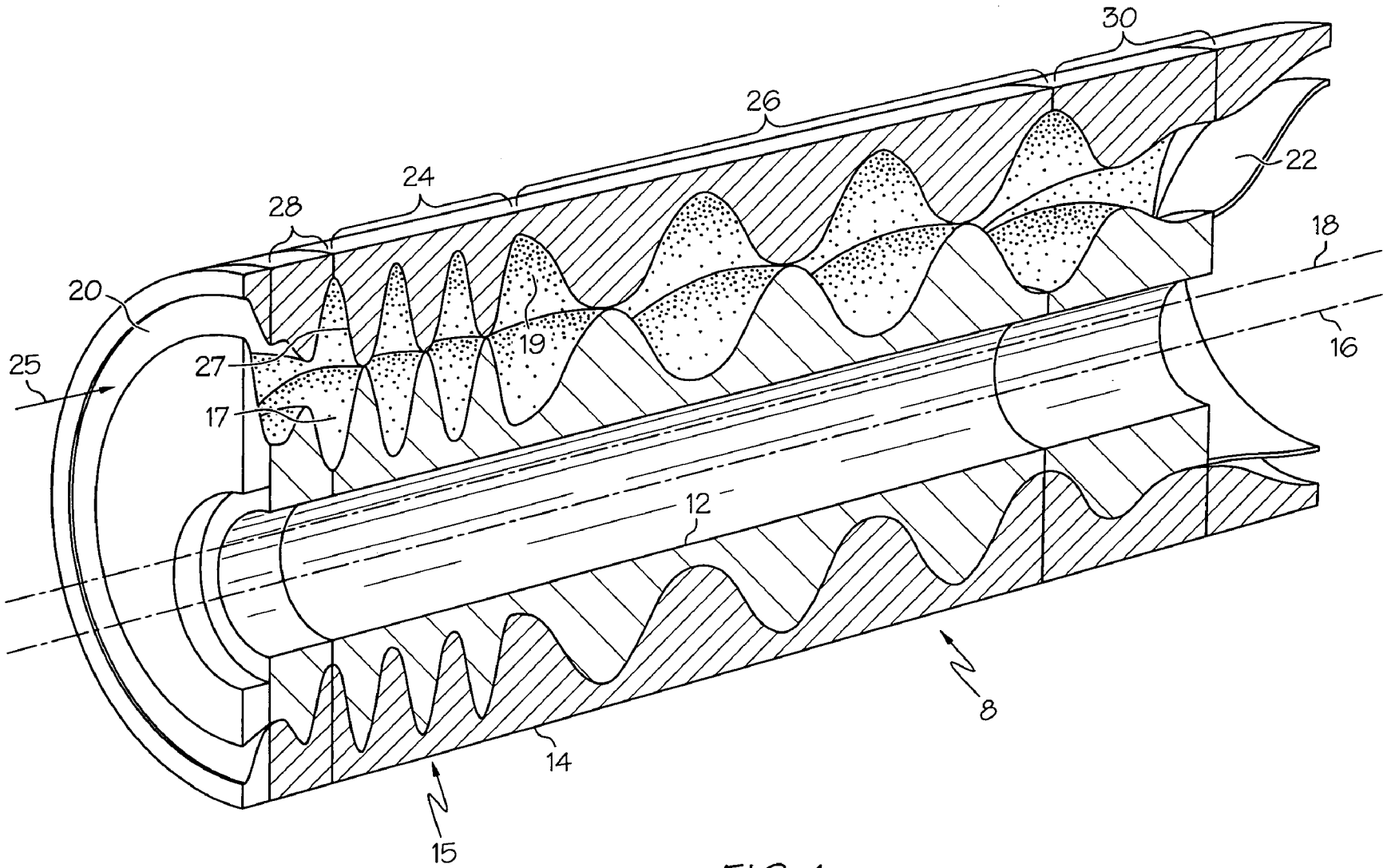
FIG. 1 is a diagrammatic cut-away perspective view illustration of a worm turbine and its inner and outer bodies.
Figure 2:
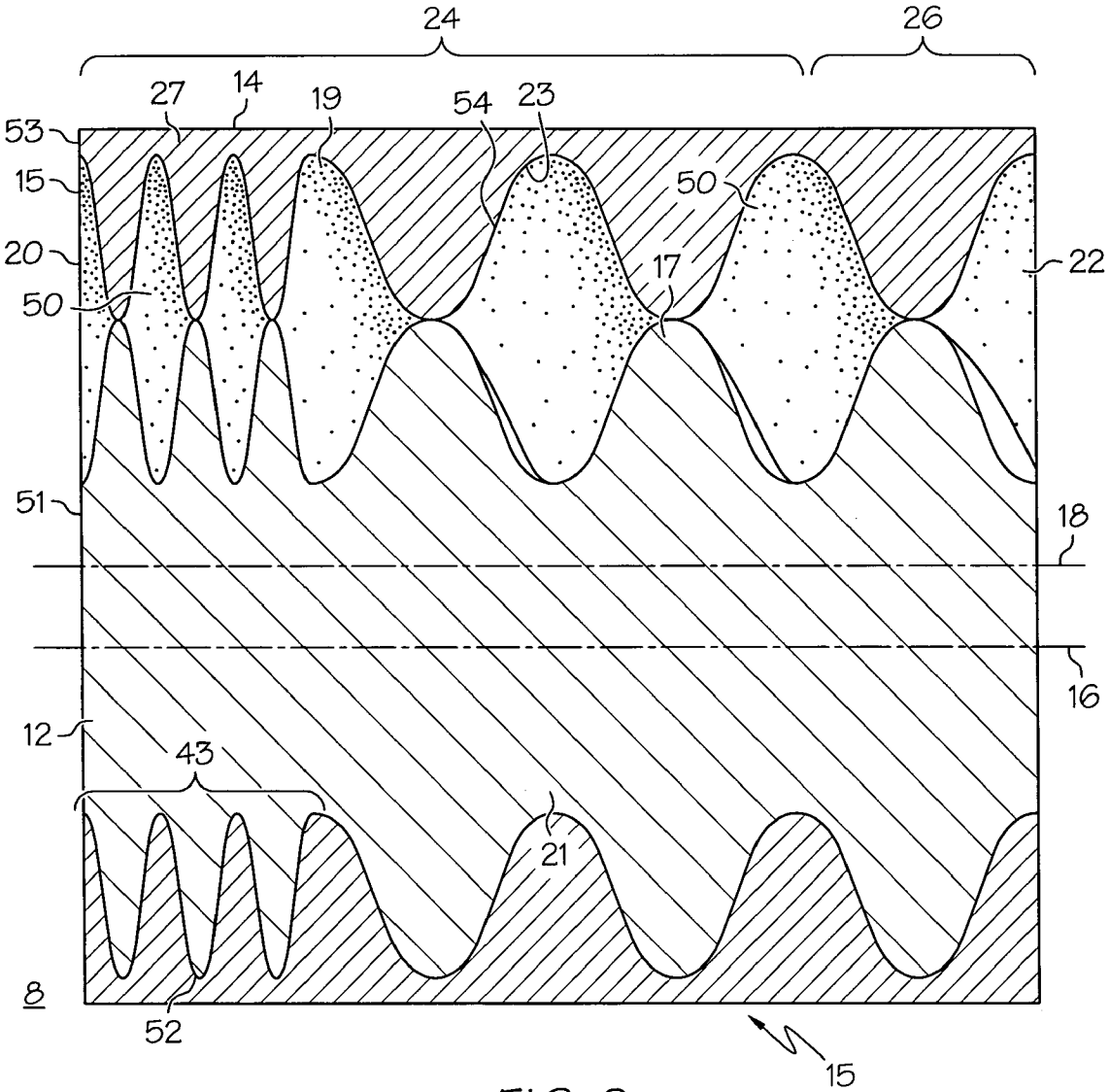
FIG. 2 is a diagrammatic cross-sectional view illustration of helical blade portions of inner and outer bodies of the worm turbine illustrated in FIG. 1.

Illustrated in FIG. 1 is a continuous axial flow positive displacement turbine also referred to as a worm turbine 8. The worm turbine 8 is an expansion machine for extracting energy from the continuous flow of working fluid 25 flowing therethrough. A charge 50 of the working fluid 25 is captured in the first section 24 and expansion of the charges 50 occurs as the charges 50 passes into the second section 26. Thus, the entire charge 50 expands while it is in both the first and second sections 24, 26.

Referring to FIGS. 1-4, the worm turbine 8 includes a relatively high pressure inlet 20 and a relatively low pressure outlet 22. A rotary assembly 15 having inner and outer bodies 12, 14 extends from the relatively high pressure inlet 20 to the relatively low pressure outlet 22. The inner body 12 is disposed within a cavity 19 of the outer body 14.

The inner and outer bodies 12, 14 have spaced apart parallel linear inner and outer axes 16, 18. The inner and outer bodies 12, 14 always both rotate about their respective axes and thus the inner and outer bodies 12, 14 are said to be rotatable about the inner and outer axes 16, 18 respectively. The rotary assembly 15 of the worm turbine 8 extracts energy continuously from the continuous flow of working fluid 25 through the inlet 20 and the outlet 22 during operation of the worm turbine 8. Individual charges 50 of fluid are captured in and by the rotary assembly 15 before being discharged at the outlet 22.

Figure 5:
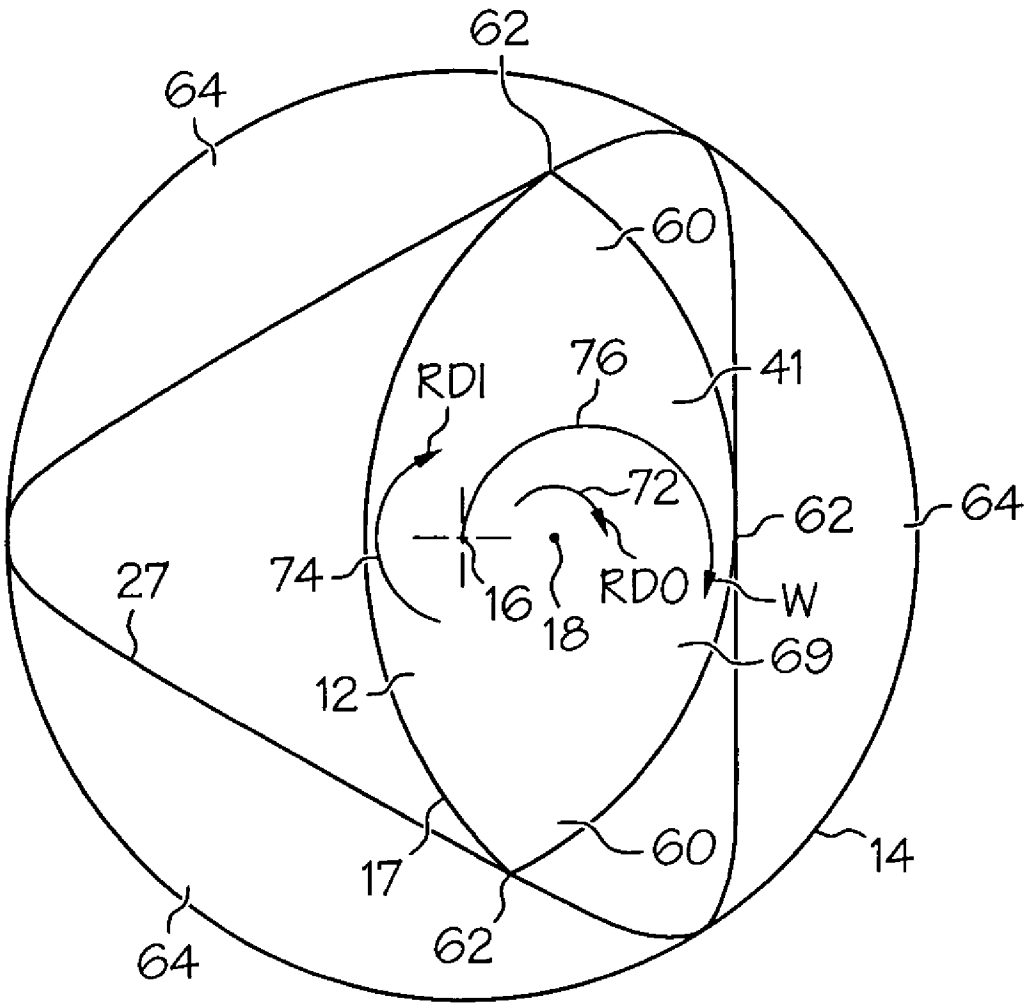
FIG. 5 is a diagrammatic axial cross-sectional view illustration of the inner and outer bodies taken through 5-5 in FIG. 3.
Figure 7:
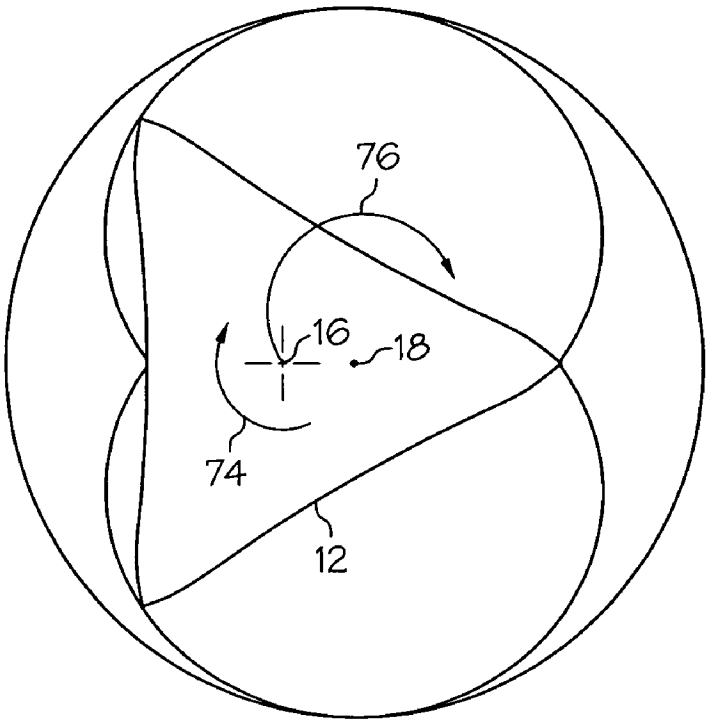
FIGS. 6-9 are diagrammatic cross-sectional view illustrations of an alternate inner and outer body configuration at different relative angular positions.

Either or both bodies may orbit about their respective axis though only one orbital body embodiment of the worm turbine 8 is illustrated herein. In one particular embodiment both bodies are rotatable and neither body orbits about the other, thus the inner and outer axes 16, 18 are fixed in space. Both bodies are rotatable and they rotate in the same circumferential direction but at different rotational speeds, determined by a fixed relationship. This is illustrated in FIG. 5 by inner and outer rotational speeds 74, 72. Thus, the inner and outer bodies 12, 14 are geared together so that they always rotate relative to each other at a fixed speed ratio and phase relationship as provided by the gearing in gearbox 82 in FIG. 3 for example. In the embodiments of the turbine 8 illustrated herein, the inner body 12 is rotatable about the inner axis 16 within the outer body 14 and the outer body 14 is rotatable about the outer axis 18.

The inner and outer bodies 12, 14 have intermeshed inner and outer helical blades 17, 27 wound about the inner and outer axes 16, 18 respectively. The rotary assembly 15 includes inlet and outlet transition sections 28, 30 to accommodate axial flow through the worm turbine 8. The inner and outer helical blades 17, 27 transition to fully developed blade profiles in the inlet transition sections 28. The inner and outer helical blades 17, 27 transition from fully developed blade profiles in the outlet transition section 30.

The inner and outer helical blades 17, 27 have inner and outer helical surfaces 21, 23 respectively. The inner helical blades 17 extend radially outwardly from an annular inner hub 51 of the inner body 12 and the outer helical blades 27 extend radially inwardly from an outer shell 53 of the outer body 14. The inner hub 51 and the outer shell 53 are axially straight and circumscribed about the inner and outer axes 16, 18 respectively. An inner helical edge 47 along the inner helical blade 17 sealingly engages the outer helical surface 23 of the outer helical blade 27 as they rotate relative to each other. An outer helical edge 48 along the outer helical blade 27 sealingly engages the inner helical surface 21 of the inner helical blade 17 as they rotate relative to each other. The inner hub 51 may be hollow as illustrated in the FIGS.

Referring to FIGS. 1-4, the worm turbine 8 has first and second sections 24, 26 in serial downstream flow relationship which is designed to extract energy from a working fluid 25 continuously flowing through the worm turbine 8 during its operation. The first and second sections 24, 26 have different first and second twist slopes 34, 36 respectively. The term twist slope corresponds to pitch. The worm turbine may have blades with a single twist slope or multiple twist slopes. The twist slopes A is defined as the amount of rotation of a cross-section 41 of the helical element (such as the oval-shaped or triangularly-shaped inner body cross-sections 69, 68 illustrated in FIGS. 5 and 6 respectively) per distance along an axis such as the inner axis 16 as illustrated in FIG. 5.

Figure 3:
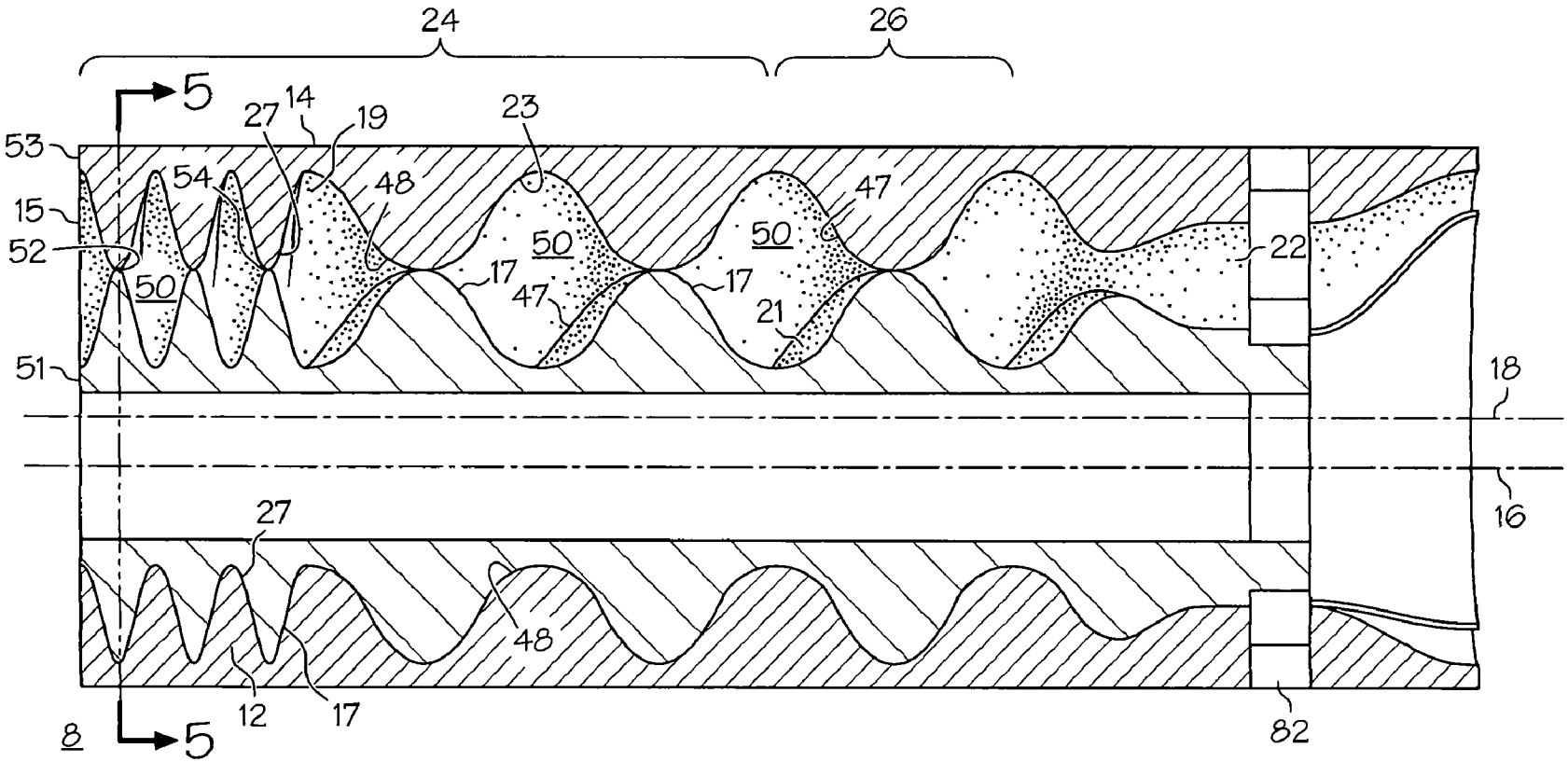
FIG. 3 is a diagrammatic cross-sectional view illustration of gearing between inner and outer bodies of the worm turbine illustrated in FIGS. 1 and 2.

The inner and outer bodies 12, 14 are illustrated in axial cross-section in FIG. 5. Referring to FIG. 5, the inner and outer bodies 12, 14 have inner and outer body lobes 60, 64 corresponding to the inner and outer helical blades 17, 27 (as illustrated in FIGS. 1 and 3) respectively. The inner and outer bodies 12, 14 can have no less than two inner and outer helical blades 17, 27 respectively and the number of outer helical blades 27 is one more or one less than the number of inner helical blades 17. Thus, each of the inner and outer bodies 12, 14 has two or more helical blades.

If the inner body 12 has N number of inner body lobes 60 or inner helical blades 17, then the outer body 14 will have either N−1 or N+1 outer body lobes 64 or outer helical blades 27. The inner body 12 is illustrated in FIG. 5 as having two inner body lobes 60 which correspond to two inner helical blades 17 and which results in a football or pointed oval-shaped inner body cross-section 69. The outer body 14 has three outer body lobes 64 which corresponds to three outer helical blades 27 (illustrated in FIGS. 2-4). Note that there are three sealing points 62 between the inner and outer bodies 12, 14 are illustrated in FIG. 5 but that there is continuous sealing between the inner and outer helical blades 17, 27 along the length of the inner and outer bodies 12, 14.

Figure 6:
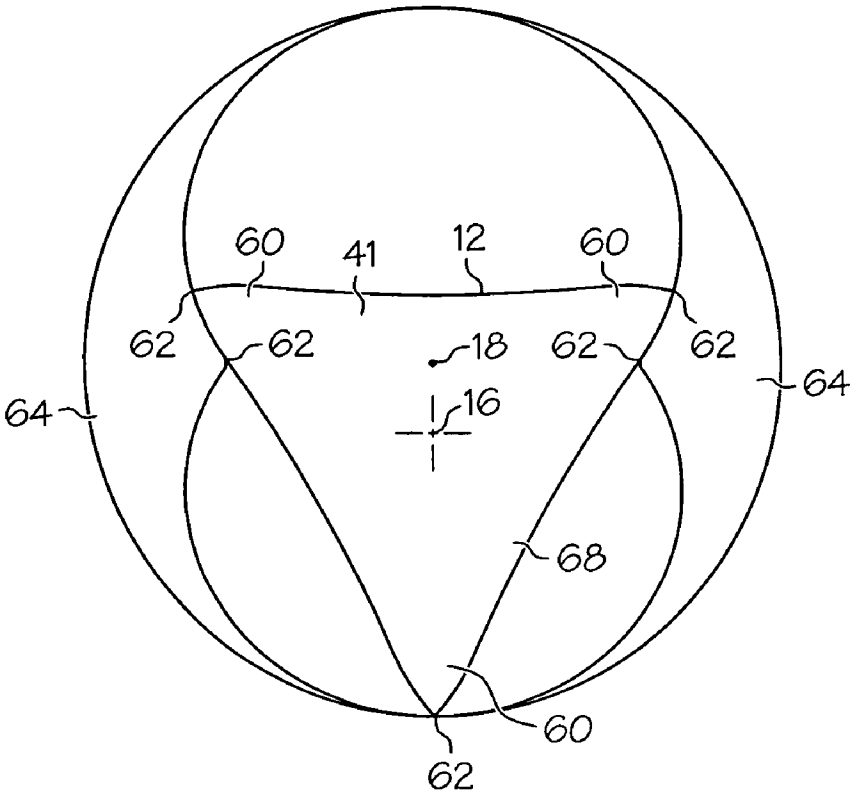

An alternative configuration of the inner and outer bodies 12, 14 is illustrated in cross-section in FIGS. 6-9. The inner body 12 is illustrated therein as having three inner body lobes 60 which correspond to three inner helical blades 17 which results in a triangularly-shaped inner body cross-section 68 as illustrated in FIG. 6. The outer body 14 has two outer body lobes 64 which corresponds to two outer helical blades 27. In general, if the inner body 12 has N number of lobes, the outer body 14 will have N+1 or N−1 lobes. Note that there are five sealing points 62 between the inner and outer bodies 12, 14 are illustrated in FIG. 6 but that there is continuous sealing between the inner and outer helical blades 17, 27 along the length of the inner and outer bodies 12, 14.

Figure 4:
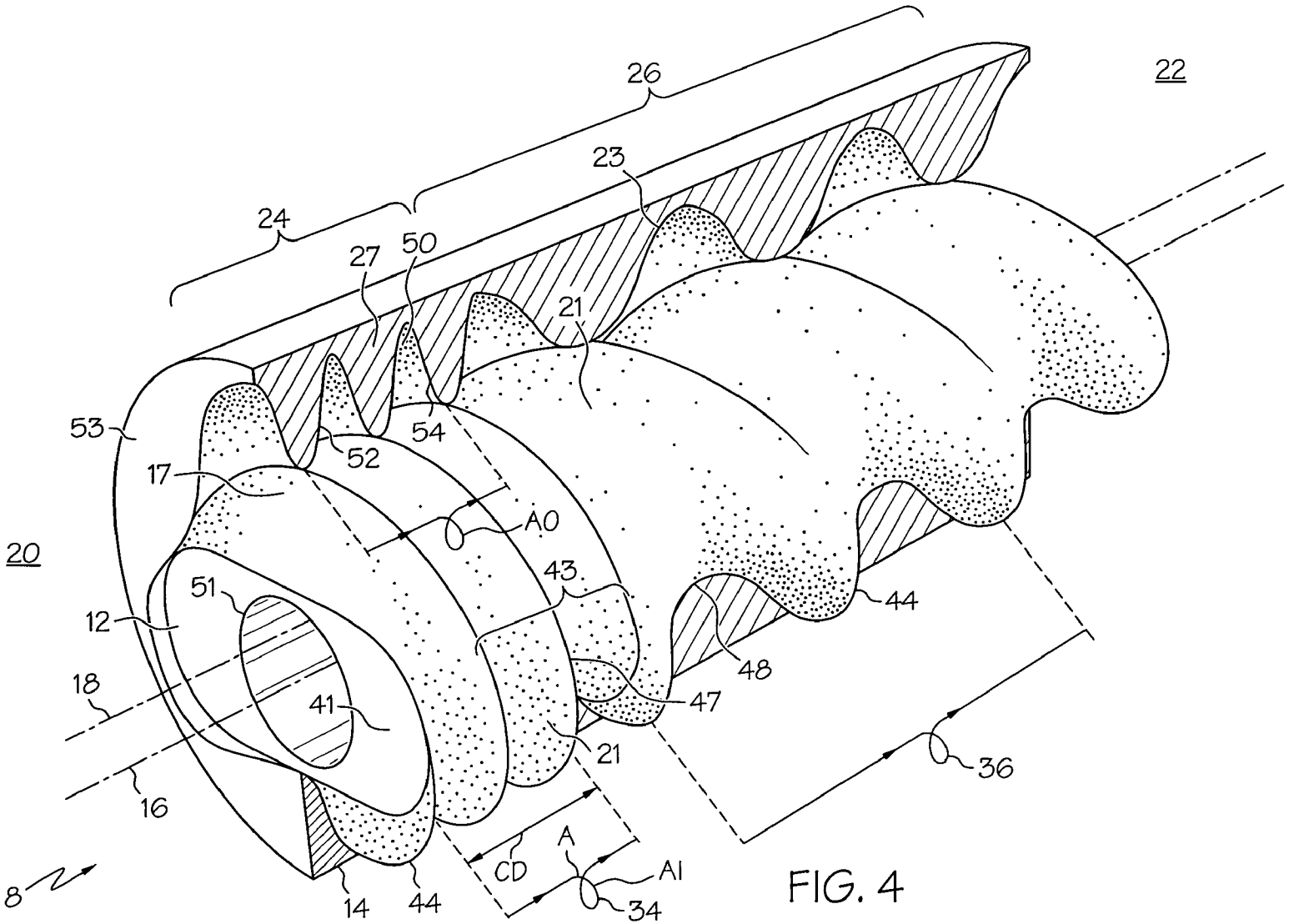
FIG. 4 is a diagrammatic partially cut away perspective view illustration of the helical blade portions of the inner and outer bodies of the worm turbine illustrated in FIGS. 1 and 2.

Referring to FIG. 4, the helical inner and outer helical blades 17, 27 have constant twist slopes A within each of the first and second sections 24, 26. Illustrated in FIG. 4 is 360 degrees of rotation of the inner body cross-section 41. The twist slope A is also 360 degrees or 2Pi radians divided by an axial distance CD between two adjacent crests 44 along the same inner or outer helical edges 47, 48 of the helical element such as the inner or outer helical blades 17, 27 as illustrated in FIG. 4.

The axial distance CD is the distance of one full turn 43 of the helix. The first twist slope 34 in the first section 24 is greater than the second twist slope 36 in the second section 26.

For the fixed outer body 14 embodiment in which the outer body 14 rotates about its outer axis 18 and does not orbit about the inner axis 16, the inner body 12 is cranked relative to the outer axis 18 so that as it rotates about the inner axis 16, the inner axis 16 orbits about the outer axis 18 as illustrated in FIGS. 6-9. The inner body 12 is illustrated as having been rotated about the inner axis 16 from its position in FIG. 6 to its position in FIG. 7, and the inner axis 16 is illustrated as having orbited about the outer axis 18 about 90 degrees. The inner and outer bodies 12, 14 are geared together so that they always rotate relative to each other at a fixed ratio as illustrated by gearing in gearbox 82 in FIG. 3. Gearing together of the inner and outer bodies 12, 14 distributes power and retains an appropriate phasing between the bodies.

If the outer body 14 in FIG. 6 was not fixed and the outer axis 18 and the outer body 14 were designed to orbit about the inner axis 16, then the outer body 14 would rotate about the outer axis 18 at 1.5 times the rotational speed that the inner body 12 rotates about the inner axis 16. The inner body 12 rotates about the inner axis 16 with an inner rotational speed 74 equal to its orbital speed 76 divided by the number of inner body lobes. The number of inner lobes are equal the number of blades.

If the inner body 12 rotates in the same direction as its orbital direction W, a two lobed outer body configuration would be required. If the inner body 12 was designed to rotate in an opposite orbital direction W, then a four lobed outer body configuration would be required.

Referring to FIG. 4, the inner and outer helical blades 17, 27 have unique, but constant inner and outer body twist slopes AI, AO respectively. A twist slope, such as the inner body twist slope AI, is defined as the amount of rotation of a cross-section 41 of the helical element (such as the triangularly-shaped inner body cross-section 68 illustrated in FIGS. 7 and 8) per distance along an axis such as the inner axis 16 as illustrated in FIG. 1. A first ratio of the outer body twist slope AO to the inner body twist slope AI is equal to a second ratio of the number of the inner helical blades 17 blades to the number of the outer helical blades 27.

The number of turns 43 of the helical blades is sufficient to mechanically capture the charges 50 of fluid, where mechanical capture is signified by a charge 50 of fluid being closed off from the inlet 20 at an upstream end 52 of the charge 50 before it is discharged through the outlet 22 at a downstream end 54 of the charge 50. The first and second exemplary embodiments of the rotary assembly 15 require 600 and 480 degrees of inner body twist, respectively, to mechanically capture fluid charges 50 and ensure that the inlet and outlet are not allowed to communicate.

The twist slopes of the outer body 14 are equal to the twist slopes of the inner body 12 times the number of inner body lobes N divided by the number of outer body lobes M. For the configuration illustrated in FIG. 6 having three inner lobes or inner helical blades 17 and two outer lobes or outer helical blades 27, 900 degrees of rotation of the outer body 14 and 600 degrees of rotation of the inner body 12 are required to mechanically capture a fluid charge 50. The displacement of fluid is accomplished by rotating either one or both of the inner and outer bodies. As the body or bodies rotate, charges of fluid are captured at the inlet in the volume between the inner and outer bodies and displaced axially aft. Following sufficient rotation, the charge of fluid is closed off from communication with the inlet and allowed to communicate with the outlet.

Figure 13:
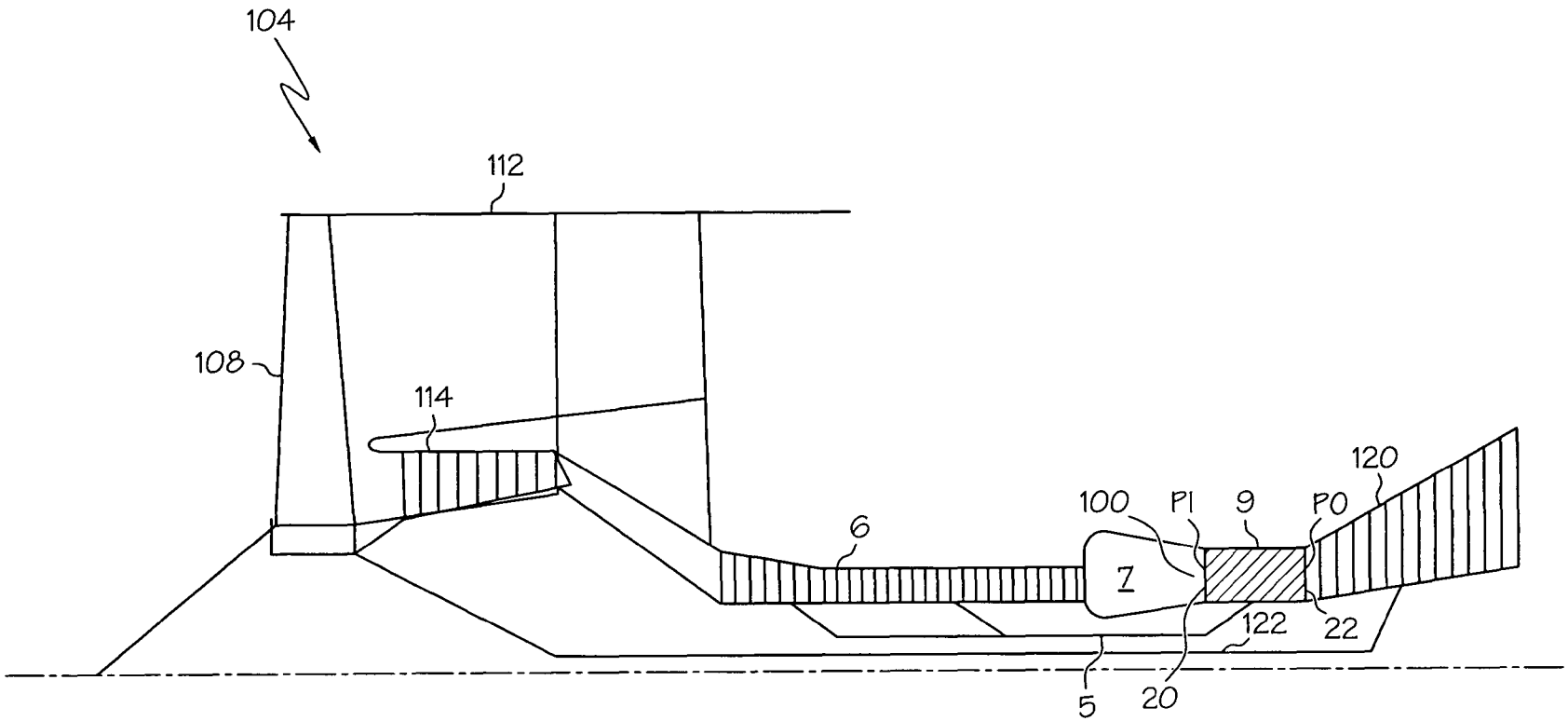
FIG. 13 is a cross-sectional view illustration of an exemplary aircraft gas turbine engine with a worm turbine.

A worm high pressure turbine 9 in an aircraft gas turbine engine 104 illustrated in FIG. 13 serves as an example. An outlet pressure PO is lower than an inlet pressure PI and, thus, shaft work is extracted from the worm turbine illustrated as a worm high pressure turbine 9. The high pressure inlet 20 is axially upstream from and adjacent to a relatively high pressure source 100 at the inlet pressure PI and the low pressure outlet 22 is axially downstream and adjacent a relatively low pressure sink 102 during operation of the turbine. One relatively high pressure source 100 might be a gas turbine engine combustor 7 while one relatively low pressure sink 102 might be a low pressure turbine 120 or a gas turbine engine exhaust nozzle or atmosphere.

The continuous axial flow positive displacement turbine, referred to herein as a worm turbine 8, may be used in a wide range of applications and is expected to provide continuous near steady fluid flow. The first embodiment provides a first mode of the turbine's operation disclosed herein in which the inner and outer bodies 12, 14 both rotate about the inner and outer axes 16, 18, respectively, and the inner and outer axes 16, 18 are fixed in space. The first mode avoids introducing a centrifugal rotor whirl effect on turbine supports. It also allows fluid to pass axially through the device in a bulk sense, without introducing a swirl component.

The inner and outer bodies are rotatable about the inner and outer axes in inner and outer rotational directions RDI, RDO respectively. The inner and outer bodies are geared together in a fixed gear ratio determined by the ratio of the number of inner helical blades to the number of outer helical blades. If the outer body axis is fixed such that it does not orbit, then the inner body rotates (spins) about the inner body axis and the inner body axis orbits about the outer body axis. If the number of the outer helical blades is one less than the number of the inner helical blades, then the inner body will spin about the inner body axis in the same direction as the inner body axis orbits about the outer body axis. If the number of the outer helical blades is one more than the number of the inner helical blades, then the inner body will spin about the inner body axis in the opposite direction to the orbit of the inner body axis about the outer body axis.

In a non orbital outer body embodiment, the outer body 14 rotates about the outer axis 18 and the outer axis 18 remains static and fixed in space. Simultaneously the inner body 12 orbits the outer body's geometric center which is the outer axis 18 and spins or rotates about the inner body's geometric center which is the inner axis 16. This static or fixed embodiment provides a second mode of the turbine operation in which there is only a single rotor that orbits.

The worm turbine 8 having two or more sections with two or more corresponding twist slopes is particularly designed for use with compressible flow working fluids such as those found in gas turbine engines. Illustrated in FIG. 13 is an exemplary aircraft gas turbine engine 104 with a worm high pressure turbine 9. The engine 104 includes a fan 108 in a fan section 112 of the engine 104 and a radially bladed low pressure compressor 114. The fan 108 and the low pressure compressor 114 are powered by a radially bladed low pressure turbine 120 through a low pressure shaft 122. A combustor 7 is operably disposed between a radially bladed high pressure compressor 6 and the worm high pressure turbine 9. The worm high pressure turbine 9 is drivingly connected to the radially bladed high pressure compressor 6 by a high pressure shaft 5.

Figure 10:
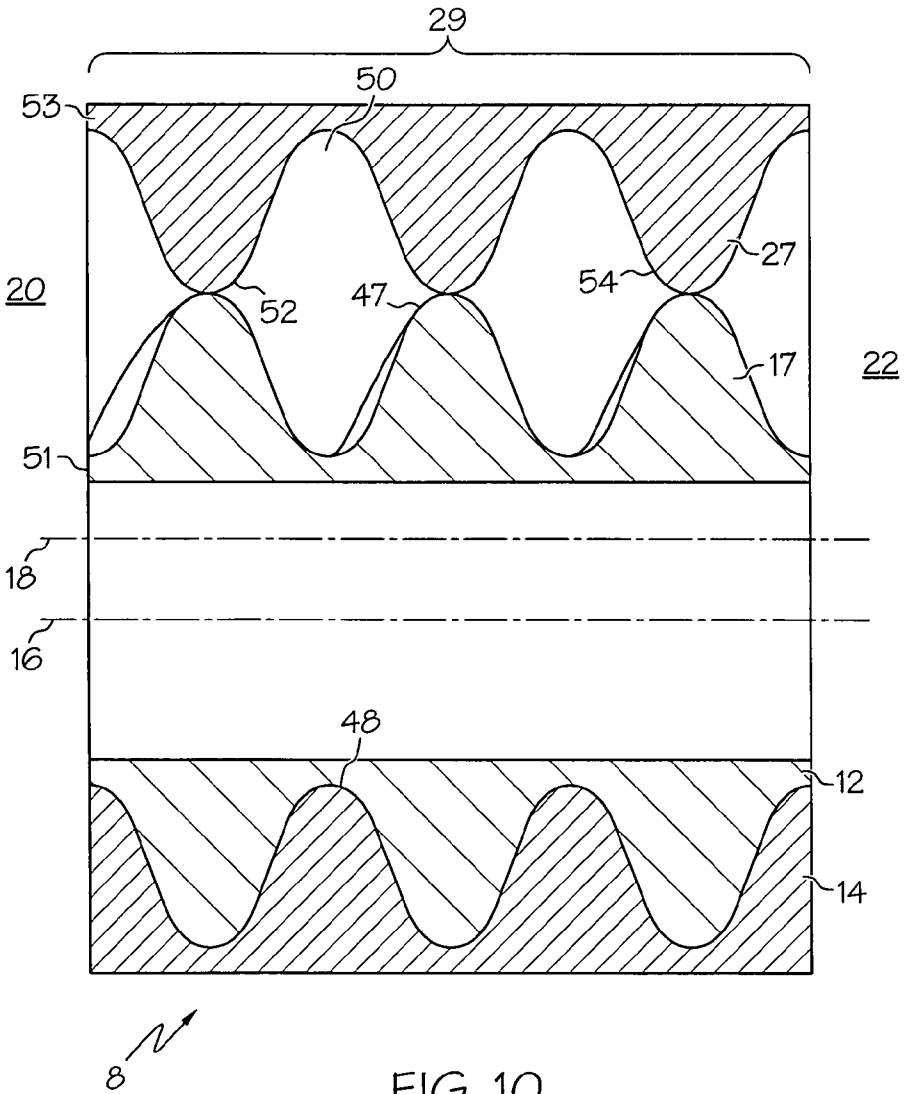
FIG. 10 is a diagrammatic cross-sectional view illustration of a single twist slope worm turbine and its inner and outer bodies.
Figure 11:
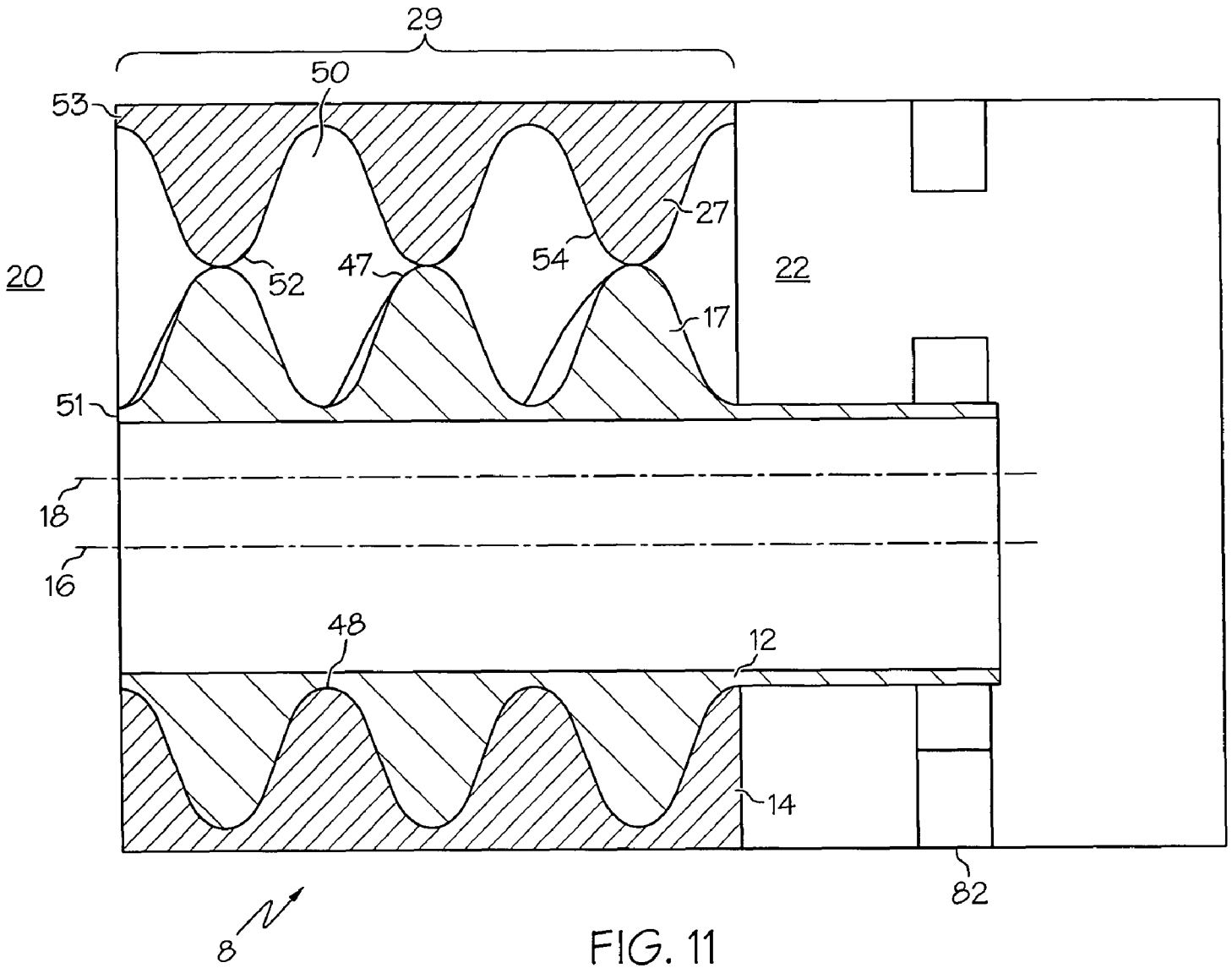
FIG. 11 is a diagrammatic cross-sectional view illustration of gearing between inner and outer bodies of the worm turbine illustrated in FIGS. 10 and 11.
Figure 12:
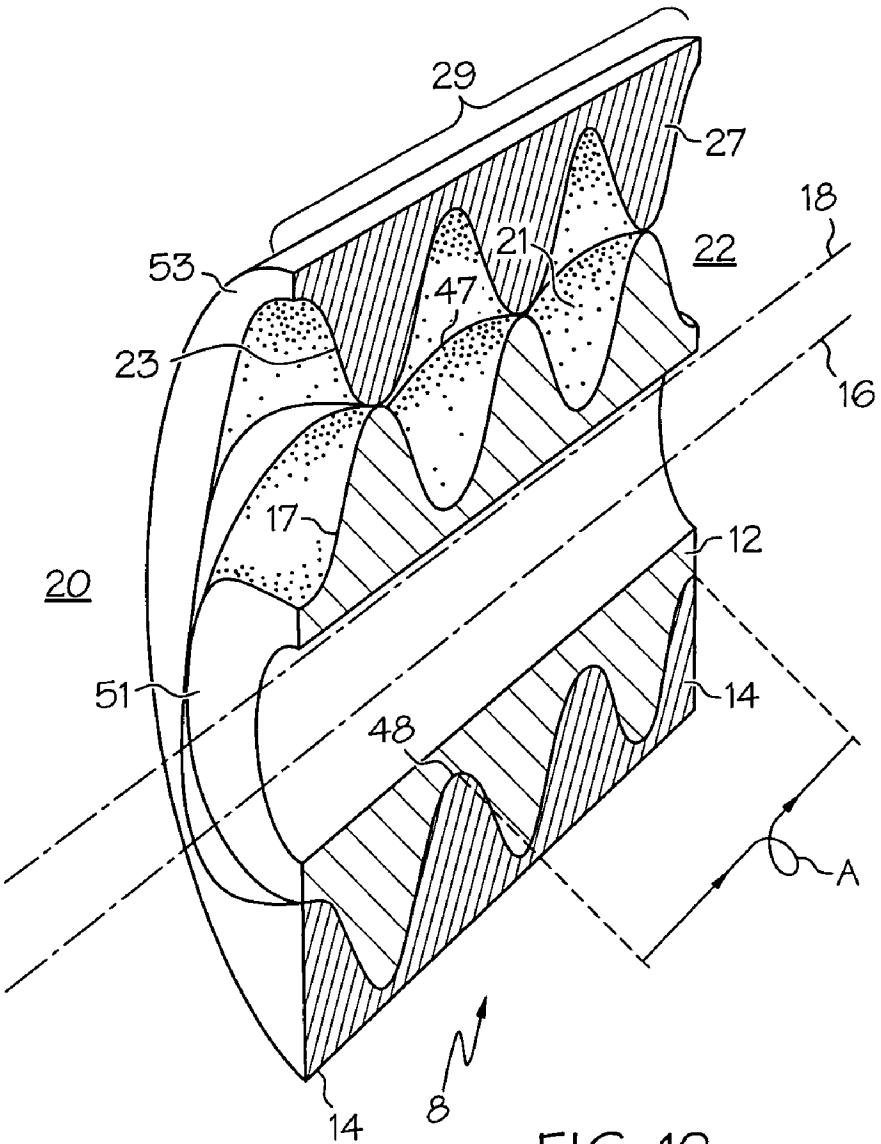
FIG. 12 is a diagrammatic cut away perspective view illustration of the helical blade portions of the inner and outer bodies of the worm turbine illustrated in FIG. 10.

Illustrated in FIGS. 10-12 is a single twist slope worm turbine 128 having only a single twist slope section 29 with only one corresponding twist slope A. It is particularly designed for use with incompressible flow working fluid flows such as a water flow 130 such as may be found in water turbines 132, one of which is illustrated in FIG. 14.

Figure 9:
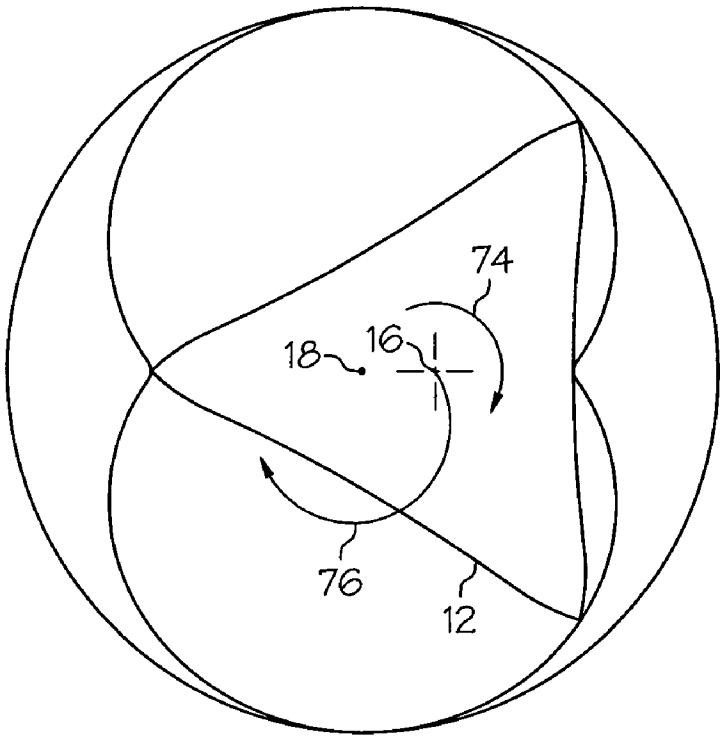
Figure 8:
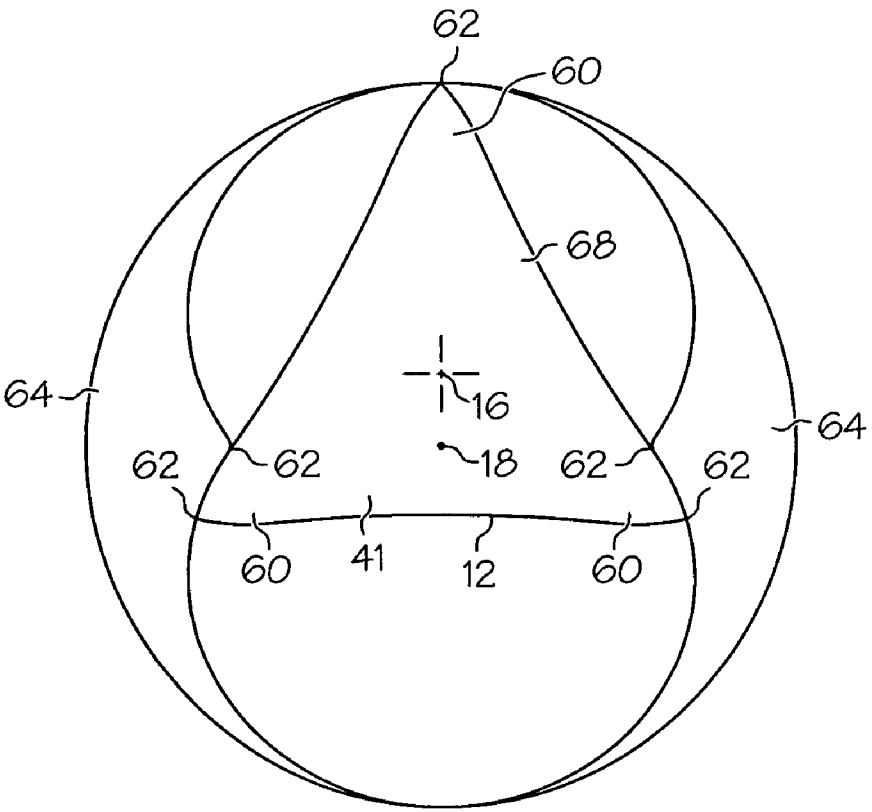
Figure 14:
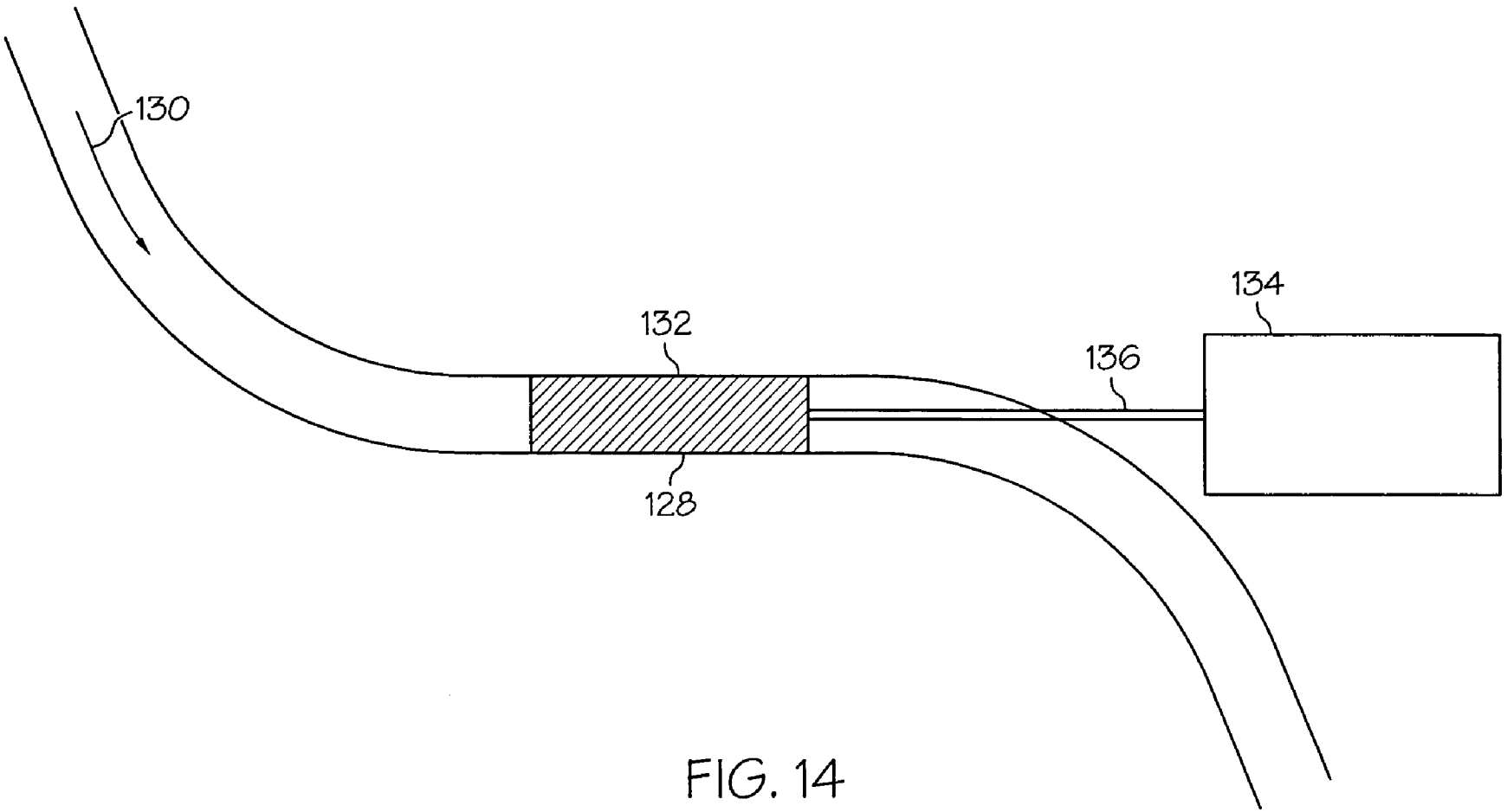
FIG. 14 is a cross-sectional view illustration of an exemplary worm water turbine.

Illustrated in FIG. 14 is an exemplary water turbine 132 with a single twist slope worm turbine 128 powering an electrical generator 134 through a shaft 136. Referring to FIGS. 9-11, the single twist slope worm turbine 128 includes inner and outer bodies 12, 14 having inner and outer body lobes 60, 64 corresponding to inner and outer helical blades 17, 27 respectively.

The inner and outer helical blades 17, 27 have unique, but constant inner and outer body twist slopes AI, AO respectively. A twist slope, such as the inner body twist slope AI, is defined as the amount of rotation of a cross-section 41 of the helical element per distance along an axis such as the inner axis 16 as illustrated in FIGS. 10-12. A twist slope is also 360 degrees or 2Pi radians divided by an axial distance CD between two successive crests 44 along the same inner or outer helical edges 47, 48 of the helical element such as the inner or outer helical blades 17, 27 as illustrated herein. The axial distance CD is the distance required for one full turn 43 of the helix.

A first ratio of the outer body twist slope AO to the inner body twist slope AI is equal to a second ratio of the number of the inner helical blades 17 blades to the number of the outer helical blades 27.

The single twist slope turbine has many of the same attributes and design configurations and restraints as the worm turbine 8 having two sections with two (or more) different twist slopes or pitches as described above. The number of blades or lobes are controlled by the same constraints and the need for gearing is the same.

The continuous axial flow positive displacement turbine, referred to herein as a worm turbine 8, may be used in a wide range of applications and is expected to provide continuous near steady fluid flow. Because the worm turbine operates in a positive displacement mode, pressure ratio is substantially independent of speed over a wide speed range. The flow is nearly directly proportional to speed over the speed and pressure ratio range of operation. It is desirable to have this independence of pressure ratio with speed as compared to a conventional turbine pressure ratio that is more or less tied directly to speed.

The worm turbine will provide turbine flow rates that are nearly independent of pressure ratio over a wide operating range as compared to conventional radially bladed axial flow turbines, for which turbine flow rates or levels may be indirectly related to turbine pressure ratio. Steady flow positive displacement operation is also expected to reduce or eliminate cavitation effects in liquid applications, which allows the turbine to be run off-design with the only ill effect being a degradation of efficiency. The worm turbine is expected to be light-weight and have far fewer parts than other axial turbines which in turn offers the potential to reduce the costs of manufacturing, installing, refurbishing, overhauling, and replacing the turbine.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention. Accordingly, what is desired to be secured by Letters Patent of the United States is the invention as defined and differentiated in the following claims.

What is claimed:

1. An axial flow positive displacement turbine comprising:

a relatively high pressure inlet axially spaced apart and upstream from a relatively low pressure outlet, a rotary assembly including an inner body disposed within an outer body and the inner and outer bodies extending from the inlet to the outlet, the inner and outer bodies having offset linear inner and outer axes respectively, at least one of the inner and outer bodies being rotatable about a corresponding one of the inner and outer axes, the inner and outer bodies having intermeshed inner and outer helical blades wound about the inner and outer axes respectively, the inner helical blades extending radially outwardly from an annular inner hub of the inner body, the outer helical blades extending radially inwardly from an annular outer shell of the outer body, the inner hub and the outer shell being circumscribed about the inner and outer axes respectively, the inner and outer bodies have inner and outer numbers of inner and outer helical blades respectively, and the inner and outer numbers of the inner and outer helical blades being two or more and the number of outer helical blades being one more or one less than the number of inner helical blades.

2. A turbine as claimed in claim 1 further comprising the helical blades having sufficient number of turns to trap fluid charges in the rotary assembly during the turbine's operation.

3. A turbine as claimed in claim 1 further comprising the inner and outer bodies being rotatable about the inner and outer axes respectively in the same rotational direction.

4. A turbine as claimed in claim 3 further comprising the inner and outer bodies being geared together in a fixed gear ratio.

5. A turbine as claimed in claim 2 further comprising the number of outer helical blades being one less than the number of the inner helical blades and the inner body being operable to orbit about the outer axis in an orbital direction and the orbital direction being same as the inner rotational direction.

6. A turbine as claimed in claim 5 further comprising the inner and outer bodies being geared together in a fixed gear ratio.

7. A turbine as claimed in claim 1 further comprising the number of outer helical blades being one more than the number of the inner helical blades and the inner body being operable to orbit about the outer axis in an orbital direction opposite the inner rotational direction.

8. A turbine as claimed in claim 7 further comprising the inner and outer bodies being geared together in a fixed gear ratio.

9. A turbine as claimed in claim 1 further comprising inner and outer body twist slopes of the inner and outer helical blades respectively a first ratio of the outer body twist slope to the inner body twist slope equal a second ratio of the inner number of the inner helical blades on the inner body to the outer number of the outer helical blades on the outer body.

10. A turbine as claimed in claim 9 further comprising the helical blades having sufficient number of turns to trap fluid charges in the rotary assembly during the turbine's operation.

11. A turbine as claimed in claim 10 further comprising the inner and outer bodies being rotatable about the inner and outer axes respectively in same rotational direction.

12. A turbine as claimed in claim 11 further comprising the inner and outer bodies being geared together in a fixed gear ratio.

13. A turbine as claimed in claim 12 further comprising the number of outer helical blades being one less than the number of the inner helical blades and the inner body being operable to orbit about the outer axis in an orbital direction same as the inner rotational direction.

14. A turbine as claimed in claim 12 further comprising the number of the outer helical blades being one more than the number of the inner helical blades and the inner body being operable to orbit about the outer axis in an orbital direction opposite the inner rotational direction.

15. A turbine as claimed in claim 14 further comprising the inner and outer bodies being geared together in a fixed gear ratio.

16. A turbine as claimed in claim 1 further comprising the outer body being non orbital about the inner axis and the inner body being operable to orbit about the outer axis.

17. A turbine as claimed in claim 16 further comprising the helical blades having sufficient number of turns to trap fluid charges in the rotary assembly during the turbine's operation.

18. A turbine as claimed in claim 16 further comprising the inner and outer bodies being rotatable about the inner and outer axes respectively in same rotational direction.

19. A turbine as claimed in claim 18 further comprising the number of outer helical blades being one less than the number of the inner helical blades and the inner body being operable to orbit about the outer axis in an orbital direction same as the inner rotational direction.

20. A turbine as claimed in claim 19 further comprising the number of outer helical blades being one more than the number of the inner helical blades and the inner body being operable to orbit about the outer axis in an orbital direction opposite the inner rotational direction.

21. A turbine as claimed in claim 18 further comprising the inner and outer twist slopes of the inner and outer helical blades respectively and a first ratio of the outer body twist slope to the inner body twist slope equal a second ratio of the inner number of the inner helical blades on the inner body to the outer number of the outer helical blades on the outer body.

22. A turbine as claimed in claim 1 further comprising the helical blades having sufficient number of turns to trap fluid charges in the rotary assembly during the turbine's operation.

23. A turbine as claimed in claim 1 further comprising first and second sections having first and second twist slopes respectively of the inner and outer helical blades and the first twist slope being greater than the second twist slope.

24. A turbine as claimed in claim 23 further comprising the inner and outer bodies being rotatable about the inner and outer axes respectively in the same rotational direction.

25. A turbine as claimed in claim 24 further comprising the inner and outer bodies being geared together in a fixed gear ratio.

26. A turbine as claimed in claim 23 further comprising the number of outer helical blades being one less than the number of the inner helical blades and the inner body being operable to orbit about the outer axis in an orbital direction and the orbital direction being same as the inner rotational direction.

27. A turbine as claimed in claim 26 further comprising the inner and outer bodies being geared together in a fixed gear ratio.

28. A turbine as claimed in claim 22 further comprising the number of outer helical blades being one more than the number of the inner helical blades and the inner body being operable to orbit about the outer axis in an orbital direction opposite the inner rotational direction.

29. A turbine as claimed in claim 28 further comprising the inner and outer bodies being geared together in a fixed gear ratio.

30. A turbine as claimed in claim 22 further comprising inner and outer body twist slopes of the inner and outer helical blades respectively a first ratio of the outer body twist slope to the inner body twist slope equal a second ratio of the inner number of the inner helical blades on the inner body to the outer number of the outer helical blades on the outer body.

31. A turbine as claimed in claim 30 further comprising the helical blades having sufficient number of turns to trap fluid charges in the rotary assembly during the turbine's operation.

32. A turbine as claimed in claim 31 further comprising the inner and outer bodies being rotatable about the inner and outer axes respectively in same rotational direction.

33. A turbine as claimed in claim 32 further comprising the inner and outer bodies being geared together in a fixed gear ratio.

34. A turbine as claimed in claim 33 further comprising the number of outer helical blades being one less than the number of the inner helical blades and the inner body being operable to orbit about the outer axis in an orbital direction same as the inner rotational direction.

35. A turbine as claimed in claim 33 further comprising the number of the outer helical blades being one more than the number of the inner helical blades and the inner body being operable to orbit about the outer axis in an orbital direction opposite the inner rotational direction.

36. A turbine as claimed in claim 35 further comprising the inner and outer bodies being geared together in a fixed gear ratio.

37. A turbine as claimed in claim 22 further comprising the outer body being non orbital about the inner axis and the inner body being operable to orbit about the outer axis.

38. A turbine as claimed in claim 37 further comprising the helical blades having sufficient number of turns to trap fluid charges in the rotary assembly during the turbine's operation.

39. A turbine as claimed in claim 37 further comprising the inner and outer bodies being rotatable about the inner and outer axes respectively in same rotational direction.

40. A turbine as claimed in claim 39 further comprising the number of outer helical blades being one less than the number of the inner helical blades and the inner body being operable to orbit about the outer axis in an orbital direction same as the inner rotational direction.

41. A turbine as claimed in claim 40 further comprising the number of outer helical blades being one more than the number of the inner helical blades and the inner body being operable to orbit about the outer axis in an orbital direction opposite the inner rotational direction.

42. A turbine as claimed in claim 34 further comprising the inner and outer body twist slopes of the inner and outer helical blades respectively and a first ratio of the outer body twist slope to the inner body twist slope equal a second ratio of the inner number of the inner helical blades on the inner body to the outer number of the outer helical blades on the outer body.

43. A turbine as claimed in claim 3 further comprising the inner and outer bodies being non orbitable and the inner and outer axes being fixed in space.

44. A turbine as claimed in claim 43 further comprising the inner and outer bodies being geared together in a fixed gear ratio.

45. A turbine as claimed in claim 43 further comprising inner and outer body twist slopes of the inner and outer helical blades respectively and a first ratio of the outer body twist slope to the inner body twist slope equal a second ratio of the inner number of the inner helical blades on the inner body to the outer number of the outer helical blades on the outer body.

46. A turbine as claimed in claim 43 further comprising the helical blades having sufficient number of turns to trap fluid charges in the rotary assembly during the turbine's operation.

* * * * *